United States Patent [19]

Binder et al.

[11] 4,174,811

[45] Nov. 20, 1979

[54] FLUID SUBSTANCE SPRAYER HAVING PROPELLANT GAS AND SUBSTANCE REFILL

[75] Inventors: Siegfried Binder, Friolzheim; Karl Herzog, Stuttgart, both of Fed. Rep. of Germany

[73] Assignee: Firma Airotechnik Siegfried Binder GmbH, Fed. Rep. of Germany

[21] Appl. No.: 876,198

[22] Filed: Feb. 9, 1978

[30] Foreign Application Priority Data

Feb. 15, 1977 [DE] Fed. Rep. of Germany ..... 2706261
Oct. 6, 1977 [DE] Fed. Rep. of Germany ..... 2744892

[51] Int. Cl.[2] ..... B65B 31/00; B65D 83/14

[52] U.S. Cl. ..... 239/308; 141/20; 222/399; 222/402.18; 239/337

[58] Field of Search ..... 222/399, 402.16, 402.18; 141/3, 20, 113; 239/304, 307, 308, 337, 346, 372, 373, 573, 579

[56] References Cited

U.S. PATENT DOCUMENTS

| | | | |
|---|---|---|---|
| 931,255 | 8/1909 | Blake | 222/402.16 |
| 1,243,733 | 10/1917 | Griffith | 239/308 X |
| 3,559,701 | 2/1971 | Wittersheim et al. | 141/20 |
| 3,648,932 | 3/1972 | Ewald et al. | 239/337 |

FOREIGN PATENT DOCUMENTS

| | | | |
|---|---|---|---|
| 1250009 | 11/1960 | France | 239/308 |
| 694346 | 9/1965 | Italy | 239/308 |

*Primary Examiner*—Robert B. Reeves
*Assistant Examiner*—Andres Kashnikow
*Attorney, Agent, or Firm*—McGlew and Tuttle

[57] ABSTRACT

A fluid substance sprayer for spraying substances, such as liquids, paste, etc., includes a container for the substance with a lifting tube extending downwardly into the lowermost portion of the container and terminating at its upper end in a discharge fitting which includes a valve for closing off the lifting tube and opening it under the control of an actuator for the discharge of the substance out through a conduit terminating in a nozzle discharge. A filling tube is also provided on the interior of the container and it connects to a filling valve. A propelling gas, such as air, may be charged into the container through the valve to the top of the container above the substance level. An air opening is advantageously provided in the lifting tube or in the connecting discharge conduit of the discharge fitting to permit either a portion of the propelling fluid to flow into the lifting tube or discharge conduit or outside air, for the purpose of insuring atomization of the fluid so that it discharges in a spray. One construction includes a separate outer container having a discharge fitting and which accommodates a separate container for the substance to be sprayed and a separate container for the propellant gas which may be inserted into an openable bottom.

12 Claims, 3 Drawing Figures

FLUID SUBSTANCE SPRAYER HAVING PROPELLANT GAS AND SUBSTANCE REFILL

FIELD AND BACKGROUND OF THE INVENTION

This invention relates to sprayers in general and, in particular, to a new and useful sprayer for substances, such as liquids, pastes, etc., comprising a pressure gas container, a lifting tube projecting into the substance to by sprayed and a discharge valve which is followed by a discharge nozzle or the like.

DESCRIPTION OF THE PRIOR ART

Sprayers are known which are designed as single use or disposable devices. The pressure gas containers thereof are filled with pressurized gas by the manufacturer and the amount and pressure are dimensioned for spraying the entire substance. The sprayer is thrown away after emptying the container. This is disadvantageous, at least economically, and, of course, also contributes to waste disposal problems. Moreover, the value of the liquid to be sprayed frequently does not exceed, or is even less than that of the sprayer itself.

SUMMARY OF THE INVENTION

The present invention is directed to a sprayer for substances, such as liquids, pastes, etc., which is reusable after emptying. In accordance with the invention, a sprayer is provided in which a pressure gas fill-up valve is mounted on the pressure gas container. The pressure gas container can be repeatedly filled with pressure gas through this valve, if needed. In this manner, the inventive sprayer can be filled up as often as desired. It is also easily possible to refill the container as soon as the pressure is no longer sufficient for the discharge of the remaining liquid content. After emptying the sprayer, the substance, i.e., liquid, paste, etc., may, of course, also be replenished. For this purpose, a pressure gas fill-up valve designed in a very advantageous manner for filling both liquid and pressure gas may also be used.

For an embodiment in which the pressure gas container also serves as a container of the substance, the invention is developed to the effect that the pressure gas fill-up valve is provided below the liquid surface, more particularly at the container bottom, and is connected to a filling tube which extends through the liquid and ends above the liquid surface. The pressure gas can thus flow directly into the container space provided therefor, and a formation of bubbles, foam, etc., at the liquid surface is prevented.

The container bottom is preferably domed inwardly and the external portion of the pressure gas fill-up valve extends, at most, up to the plane of the peripheral rim of the bottom. Consequently, the container can be placed upright without being impeded by the valve. In addition, with a container set up in this manner, the valve is protected against contamination and damage.

In a particularly preferred embodiment of the invention, at least one air inlet passage opens into the liquid conduit between the orifice of the discharge nozzle and the liquid surface. The pressure gas which is usually employed for so-called spray cartridges is suspected of possibly polluting the environment. On the other hand, this gas has the advantage that it mixes very intimately with the liquid so that a very fine spray is obtained at the nozzle or the like.

Accordingly, if normal air, which is much less expensive and which does not endanger the environment is used, instead of this gas, then, in the absence of special measures, no fine spray is obtained at the discharge nozzle or the like, but rather larger drops are produced because the air, as previously mentioned, does not mix with the liquid or other liquidy or pasty substance received in the container as well as the usual pressure gas. In many applications, the result thereby obtained is unsatisfactory or even useless. If, however, in accordance with the above-mentioned preferred embodiment of the invention, an air inlet passage is provided, which opens into the liquid conduit and through which air can flow in from the outside, the nozzle is supplied with an air-liquid mixture which is discharged as a fine spray. Thus, the end effect is comparable and equivalent to that of the conventional spray cartridges filled with the above-mentioned pressure gas.

According to a further development of the invention, the air inlet passage extends through the wall of the lifting tube and opens into the pressure gas container. The gas present in the container, more particularly air, passes through the air inlet passage into the lifting tube in which the substance, such as liquid, paste, etc., rises under the pressure present in the pressure gas container. This gas-liquid mixture flows through the liquid conduit and is then discharged as a fine spray.

According to another variation of the invention, the air inlet passage communicates with the outside air. In such a case, the lifting tube conveys only the liquid, etc. The outside air is taken in by the suction effect of the substance flowing toward the discharge nozzle and is entrained. The mixing again takes place in the remaining portion of the liquid conduit. The nozzle again discharges a very fine spray. In this connection, it is particularly advantageous to design the liquid conduit in the zone of the air inlet passage as a Venturi nozzle. The intake of the outside air is induced by the substance flow in a well-known manner.

In another embodiment of the invention, the cross-section of the air inlet passage is variable, particularly controllable. This makes it possible to adjust the fineness of the spray to the respective application. Particularly favorable conditions are obtained if, in accordance with a further development of the invention, the portion of the liquid conduit upstream of the air inlet passage is designed for varying, particularly controlling, the cross-sectional area. The pressure gas or air to liquid ratio is then determined by the ratio of the two cross-sectional areas, namely, that of the air inlet passage and that of the liquid or substance conduit. Depending on the substance to be sprayed and the desired working effect, this ratio can be varied.

In another preferred embodiment of the invention, the pressure gas container is detachably connected to a liquid container and is provided with a delivery tube which projects air-tightly into the liquid container and carries a delivery valve at its free end which is actuable conjointly with the discharge valve of the sprayer. In a well known and advantageous manner, the discharge valve comprises an actuating member which is designed as a pushbutton and can be pushed down against the action of a return spring and in which the discharge nozzle is provided at the same time. An extension of this actuating member, or of an interposed element, particularly in the shape of a pin, may extend air-tightly, for example, through the liquid container and thus be coupled to the delivery valve. Upon pushing the actuating member down, the delivery valve and the discharge valve are opened simultaneously in the desired manner. In consequence, the pressure gas passes into the liquid container and forces the liquid contained therein through the lifting tube to the discharge nozzle.

In a further development of the invention, it is provided that the pressure gas container is disposed below the liquid container and that both containers are encased in a common two-part receptacle, more particularly, a receptacle which has a removable bottom. In such a case, the delivery tube extends air-tightly through the bottom of the liquid container. The bottom of the receptacle may be held in place by means of a slide lock or a thread. The receptacle may also be split at an intermediate location, for example, in the common plane of contact of the two containers.

Accordingly, it is an object of the invention to provide an improved sprayer for fluid substances, such as liquids and pastes, which comprises a pressure gas container containing a substance to be sprayed therein and also adapted to be charged with a gas for propelling the substance, and including a lifting tube projecting into the substance, connected at its upper end to a discharge fitting, including a valve connected to the lifting tube and a discharge nozzle which follows the valve which extends into the atmosphere, and which also includes a pressure gas filler valve means mounted on the pressure gas container for filling the container with a pressure gas for pressurizing the substance so that it will flow up the lifting tube and out of the discharge nozzle.

A further object of the invention is to provide a sprayer for liquids which includes a housing containing a separate container for the substance to be sprayed and a container for a propellant gas and which includes a lifting tube extending into the substance and terminating at its upper end in a valve actuating means for spraying the substance out through the lifting tube and a discharge nozzle and which further includes means for providing a connection between the propelling gas container and the substance container having separate valve means which are actuable to permit the flow of the pressure gas into the substance container for pressurizing the substance for flow out through the discharge nozzle.

Another object of the invention is to provide a fluid substance sprayer having propellant gas and substance refill which is simple in design, rugged in construction, and economical to manufacture.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
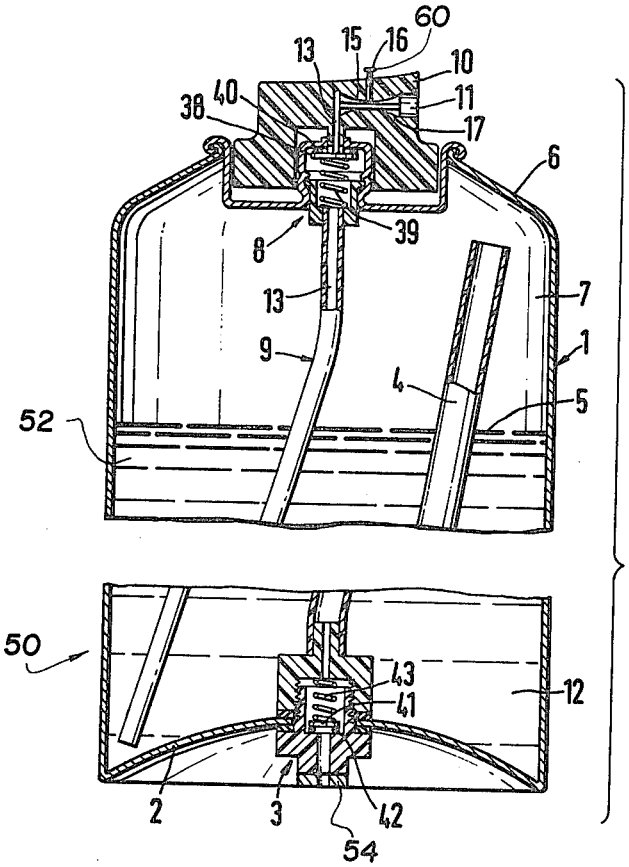
FIG. 1 is an exploded vertical sectional view of a spray device constructed in accordance with the invention.

Referring to the drawings in particular, the invention embodied therein in FIG. 1, comprises a spray device, generally designated 50, which includes a housing 1, such as a type known for conventional sprays or atomizers. A bottom 2 of housing 1 is domed inwardly and carries a centrally located pressure gas fill-up valve 3, in accordance with the invention. Since housing 1 serves, at the same time, as a supply container for both the liquid, paste, etc. to be sprayed and for the driving gas, a filling tube 4 is provided which connects to the pressure gas fill-up valve 3 and extends through the liquid or similar fluid substance 52. The substance 52 may also be introduced through valve 3 for flow up tube 4 to the space above surface 5, in particular, up to the upper end 6 of the housing. The space within the housing provided for the pressure gas, preferably normal air, is designated 7.

A discharge valve 8, which may be of the design known from conventional atomizers, is mounted on the upper end 6 of the housing 1. A lifting tube 9 is connected to discharge valve 8 in the interior, which tube extends down to bottom 2 and preferably ends in the lowermost zone of the housing. This makes it possible to empty housing 1 almost completely. The discharge nozzle 11, or the like, is formed on the actuating member 10 of discharge valve 8, which is designed as a pushbutton.

As soon as discharge valve 8 is opened by pushing down actuating member 10, the pressure gas present in housing space 7, preferably compressed air, forces the liquid 12 to by sprayed from below into the lifting tube 9 and, from there, to nozzle 11, where it is discharged in the form of a spray. In accordance with the invention, the sprayer is designed for reuse, i.e., after emptying its contents, the sprayer can be refilled with liquid and pressure gas. Since only compressed air, at most, is available to a normal consumer, it will be necessary to use this medium to refill the sprayer. Compressed air is available, for example, in gasoline stations. However, compressed air is not easily inclined to mix with the liquid contained in the sprayer and, consequently, a fine spray is obtained only upon providing further measures, in accordance with the invention.

Figure 2:
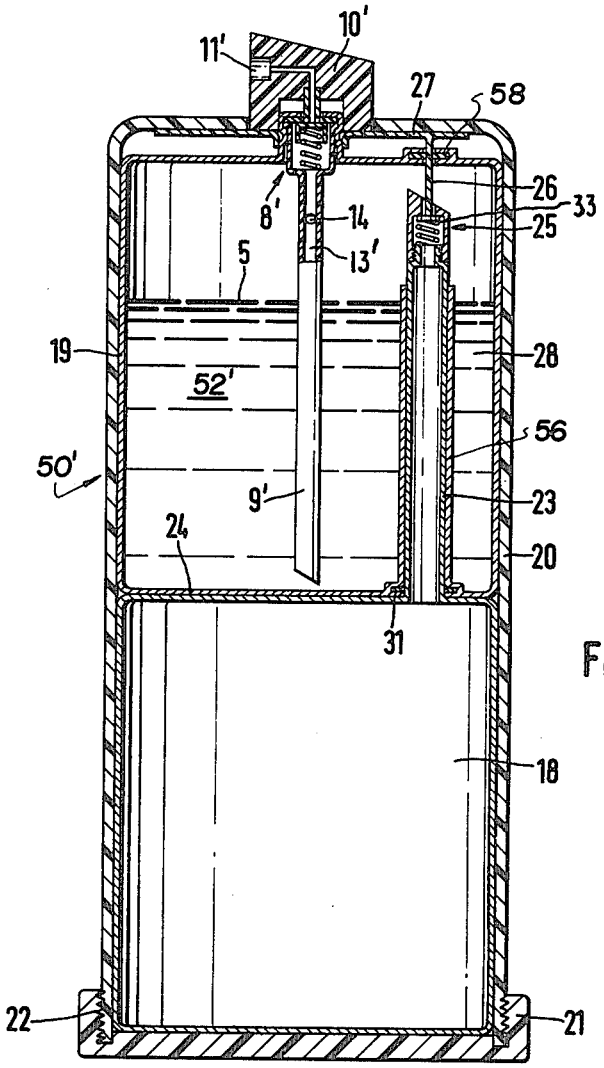
FIG. 2 is a vertical sectional view of another embodiment of spray device.

For this purpose, as seen in FIG. 2 at least one air inlet passage 14, opening into liquid conduit 13', is provided between the orifice of nozzle 11' or the like and the liquid surface 5. A similar inlet passage may be provided in conduit 13 of FIG. 1. Air is admixed to the rising substance, such as liquid, paste, etc., through this passage, which air passes, along with the substance, to nozzle 11 or 11', where it ensures the production of a fine spray. The air inlet passage may be designed as a cross-bore 14 which is provided in that portion of lifting tube 9' which extends above liquid surface 5, and through which compressed air from housing space of a container 19 in FIG. 2 or space 7 in FIG. 1, passes into liquid conduit 13' or 13. Alternatively, as seen in FIG. 1, the air passage comprises a cross-bore 16 which is provided in actuating member 10 transversely to a conduit portion 15 of the liquid conduit, as shown, and through which outside air enters liquid conduit 13 close upstream of the discharge nozzle. To increase the suction effect for the outside air, the conduit portion 15 may advantageously comprises a Venturi nozzle 17 which is indicated in broken lines in FIG. 1. The embodiment of FIG. 2 can alternatively use a Venturi and air passage like that of FIG. 1 to enhance spraying.

Pressure gas fill-up valve 3 is provided with a nipple 54 to which a conventional delivery valve of compressed air stations can be connected. Further, the cross-section of air inlet passages 14 or 16 is advantageously variable. For passage 16, for example, this can be done such as by an adjustment pin 60, in order to adjust the air supply to the material to be sprayed. For the same reason, the cross-sectional area of that portion of liquid conduit 13 or 13' which is located upstream of the air inlet passage is made variable. For any particular material to be sprayed, conduits 13 or 13' and passage 14 may be, before assembly of the device, produced at particular diameters which are specific for the material to be sprayed, with the diameters variable for different materials, in different devices.

In the first embodiment of the invention, the pressure gas container serves as a container of the substance to be sprayed. According to FIG. 2, a spray device 50' includes a separate pressure gas container 18 and a container 19 for the substance to be sprayed. Pressure gas container 18 is disposed below liquid container 19 in a common conformable receptacle 20 which encloses both containers and has a removable bottom 21. Bottom 21 may be held in place, for example, by means of a slide lock or a thread 22. An actuating member 10' of discharge valve 8' and discharge nozzle 11' are provided on the top of receptacle 20. A lifting tube, designated 9', extends from valve 8' to the lower end of the container 19.

A pressure gas container 18 carries a delivery tube 23 which is passed air-tightly through an upwardly extending tube 56 secured to the bottom 24 of liquid container 19. Delivery tube 23 carries a delivery valve 25 at its upper free end. Delivery valve 25 and discharge valve 8' may be opened by means of a common actuating member 10'. For this purpose, an actuating pin 26 is provided either on actuating member 10' or on an additional pressure plate 27. Pin 26 extends air-tightly through a journal 58 of the wall of liquid container 19. Since containers 19 and 18 are removable from receptacle 20, access is had to plate 27 and the top of pin 26 so that pin 26 can be detached from a plate 33, shown in FIG. 2, to permit separation of container 19 from container 18.

If actuating member 10' is pushed down, pressure gas passes from pressure gas container 18 into the interior of liquid container 19 and drives liquid 28 contained therein through lifting tube 9' to discharge nozzle 11'. At this point, the pressure gas and liquid escape in the form of a spray. The liquid container may, of course, also contain a paste or the like 52', as has been provided in housing 1 of the first embodiment of the invention. The inventive sprayer may thus also be used to produce a foam or the like. Particularly for producing a foam, a small tube is advantageously connected to the discharge valve 8' or discharge nozzle 11'.

In a very advantageous manner, and according to a further feature of the invention, delivery valve 25 serves at the same time as a fill-up valve through which the pressure gas container can be filled or refilled in a filling station simply by connecting it to the plug nipple. In the embodiment of FIG. 2, the liquid container 19 need not necessarily be pressure-tight, it is rather a throw-away container. In this embodiment again, an air inlet passage in the actuating member 10' and the tube 9' (not shown) and the constructional measures described above may be provided.

Figure 3:
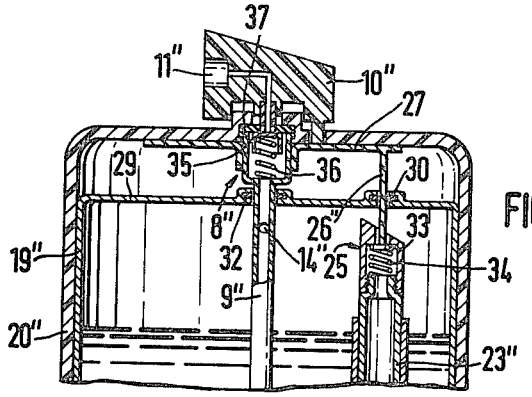
FIG. 3 is a partial sectional view of still another embodiment of the invention.

The embodiments of FIGS. 2 and 3 differ from each other substantially only in that, according to FIG. 2, discharge valve 8' is supported on a liquid container 19 which, in the embodiment of FIG. 3, a discharge valve 10" is mounted on the outer receptacle 20". For this reason, in the latter case, lifting tube 9" is passed air-tightly through a top 29 of liquid container 19". Thereby, the embodiment of FIG. 3 fully meets the requirement of a particularly simple, and thus inexpensive construction of the liquid container 19" and the pressure gas container 18" (not shown but similar to the embodiment of FIG. 2) which may be disposed of as throw-away articles.

Actuating pin 26", delivery tube 23", and lifting tube 9" in FIG. 3, are each passed through a gasket 30, 31, 32, respectively with gasket 31 shown only in FIG. 2. These gaskets are initially not provided with a passage opening, but rather they are pierced as soon as the mentioned members of this variation are assembled with each other. For this purpose, the free ends at least of delivery tube 23" and lifting tube 9" are beveled to a point.

Delivery valve 25 comprises a simple sealing plate 33 which, in the open state, is skirted by the flow and is pressed against its seat by means of a helical compression spring 34. Upon pushing actuating member 10" down, plate 33 is lifted from its valve seat by actuating pin 26", as may be seen from FIG. 3. It then returns into it initial closed position as soon as actuating member 10" is released again.

Discharge valve 8" is designed in a well-known manner. The closing member 35 thereof as seen in FIG. 3 is pressed against the valve seat 37 which comprises, for example, a punched rubber gasket, by means of a helical compression spring 36. In FIG. 1, a sealing plate is again used, and is designated 38. Aside from this, sealing plate 38 and discharge valves 8, 8' and 8" comprise a loading spring 39 and an O-ring 40 serving, at the same time, as a valve seat. The free end of a spiked extension of the actuating member applying against sealing plate 38 is slotted, in order to provide a flow passage.

Pressure gas valve 3 is comparable with the discharge valve 8, and comprises a sealing plate 41, an O-ring 42, serving as a valve seat, and a loading spring 43.

With specific embodiments of the invention have been shown and described in detail to illustrate the application of the principles of the invention, it will be understood that the invention may be embodied otherwise without departing from such principles.

What is claimed is:

1. A sprayer for substances, such as liquids, and pastes, comprising a first container having a top with a spray fitment thereon, said spray fitment including a delivery conduit terminating in a spray nozzle discharge, a discharge valve associated with said fitment mounted on said first container and being actuable by said fitment to open and close the top of said first container, a lifting tube connected to the top of said first container and to said discharge valve and having a lower end extending downwardly into the substance to be sprayed, a pressure gas fill-up valve mounted in said first container having an opening for the inflow of a pressure gas into said first container for pressurizing the substance to flow up said lifting, tube through said discharge valve and through said delivery conduit for spraying out through said nozzle and including means for adding a pressure gas into the substance which flows out through said discharge valve and said nozzle, said first container including an opening in the bottom thereof, a pressure gas container having a top with a delivery tube extending outwardly therefrom into the opening of said container in pressure-sealed engagement therewith, said fill-up valve comprising a delivery valve in said delivery tube and means for actuating said delivery valve.

2. A sprayer for substances, as claimed in claim 1, wherein said means for actuating said delivery valve includes said fitment and a pin connectable to said fitment and being displaceable by displacement of said fitment to actuate said delivery valve.

3. A sprayer for substances, as claimed in claim 2, including a separate housing containing said first container and said pressure gas container, said fitment being displaceably mounted on said housing over said first container.

4. A sprayer for substances, as claimed in claim 3, wherein said delivery valve is disposed in said housing.

5. A sprayer for substances, such as liquid and pastes, comprising a first container having a substance therein to be sprayed, a lifting tube projecting into the substance and extending downwardly in said first container, a discharge fitting connected to the upper end of said lifting tube including a discharge valve connected to said lifting tube and having a discharge portion terminating in a discharge nozzle connected to said discharge valve, means for actuating said discharge valve, and a pressure gas fill-up valve means mounted in said first container having a passage into said first container for a pressure gas for pressurizing the substance so that it will flow up said lifting tube and out of said discharge nozzle, a second container for a pressure gas having a delivery tube portion, said first container having a receiving sleeve into which said delivery tube portion is extendable, said delivery tube portion having said fill-up valve means connected thereto which comprises a delivery valve for the discharge of the pressure gas from said second container and for filling said second container with the pressure gas and means for actuating said delivery valve.

6. A sprayer for substances, as claimed in claim 5, including an air passage communicating with said discharge portion for the admission of air into the substance flow.

7. A sprayer for substances, as claimed in claim 5, including an inlet passage opening into said lifting tube above the layer of the substance for the inflow of the pressure gas thereinto for aiding and atomizing the liquid into a spray.

8. A sprayer for substances, as claimed in claim 5, wherein said discharge portion includes a Venturi section and means for admitting air into said Venturi section.

9. A sprayer for substances, as claimed in claim 8, wherein said means for admitting air in said Venturi section comprises an air inlet passage which is variable.

10. A sprayer for substances, as claimed in claim 5, wherein there is at least one air inlet passage opening into at least one of said lifting tube and said discharge portion.

11. A sprayer for substances, as claimed in claim 5, wherein said lifting tube includes an air inlet, the cross-sectional area of said lifting tube upstream of said air inlet being variable for different liquids to be sprayed.

12. A sprayer for substances, as claimed in claim 5, wherein said second container is located below said first container, including an outer housing holding said first container and said second container together, said delivery tube portion extending air-tightly through the bottom of said first container and through said receiving sleeve therein.

* * * * *